US012102116B2

(12) United States Patent
Shoor et al.

(10) Patent No.: US 12,102,116 B2
(45) Date of Patent: Oct. 1, 2024

(54) HOLLOW LEAF TUBE WITH FLAVOR CAPSULE

(71) Applicant: Good Tree International, Inc., Jurupa Valley, CA (US)

(72) Inventors: Kunal Shoor, Jurupa Valley, CA (US); Brandon Puett, Jurupa Valley, CA (US)

(73) Assignee: Good Tree International, Inc., Jurupa Valley, CA (US)

( * ) Notice: Subject to any disclaimer, the term of this patent is extended or adjusted under 35 U.S.C. 154(b) by 0 days.

(21) Appl. No.: 18/479,536

(22) Filed: Oct. 2, 2023

(65) Prior Publication Data

US 2024/0032585 A1 Feb. 1, 2024

Related U.S. Application Data

(60) Division of application No. 18/174,998, filed on Feb. 27, 2023, now Pat. No. 11,785,981, which is a (Continued)

(51) Int. Cl.
*A24D 1/02* (2006.01)
*A24D 3/04* (2006.01)
(Continued)

(52) U.S. Cl.
CPC ..... *A24D 1/022* (2013.01); *A24D 3/048* (2013.01); *A24D 3/061* (2013.01); *A24D 3/08* (2013.01)

(58) Field of Classification Search
None
See application file for complete search history.

(56) References Cited

U.S. PATENT DOCUMENTS 3,199,515 A 8/1965 Lowe
3,490,461 A 1/1970 Osmalov
(Continued)

FOREIGN PATENT DOCUMENTS

CN 101203148 B 9/2012
GB 2549803 11/2017
(Continued)

OTHER PUBLICATIONS

King Palm Corn Husk Filters, Amazon.com, 2018, [online], retrieved from the Internet, [retrieved Nov. 28, 2023], , URL:https://www.amazon.com/King-Palm-Filters-Natural-Effective/dp/B07FTX7HLS> (Year: 2018).*
(Continued)

*Primary Examiner* — Dennis R Cordray
(74) *Attorney, Agent, or Firm* — Dickinson Wright PLLC; Mark W. Catanese; Hector A. Agdeppa

(57) ABSTRACT

A device for burning smoking material and inhaling the resulting smoke is disclosed. The device can include a tubular member formed from a dried leaf having an internal elongated cavity extending from an open end to a closed end. The elongated cavity can be configured to receive a smoking material. The smoking accessory can include a filter disposed within dried leaf and defining the closed end. The filter can have a recess formed in a surface of the cylindrical body along a curved face extending from the first end to the second end, the recess extending radially into the cylindrical body. The smoking accessory can include a capsule containing a flavoring agent disposed within the recess.

16 Claims, 2 Drawing Sheets

Related U.S. Application Data continuation of application No. 17/727,214, filed on Apr. 22, 2022, which is a continuation of application No. 16/746,638, filed on Jan. 17, 2020, now Pat. No. 11,311,044.

(51) Int. Cl.
*A24D 3/06* (2006.01)
*A24D 3/08* (2006.01)

(56) References Cited

U.S. PATENT DOCUMENTS

| | | | |
|---|---|---|---|
| 3,550,508 | A | 12/1970 | Wartman, Jr. |
| 3,910,288 | A | 10/1975 | Hammersmith |
| 4,865,056 | A | 9/1989 | Tamaoki |
| 4,889,144 | A | 12/1989 | Tateno |
| 5,568,819 | A | 10/1996 | Gentry |
| 6,041,790 | A | 3/2000 | Smith |
| 7,152,609 | B2 | 12/2006 | Li |
| 7,578,298 | B2 | 8/2009 | Karles |
| 7,793,665 | B2 | 9/2010 | Dube |
| 7,827,997 | B2 | 11/2010 | Crooks |
| 7,836,895 | B2 | 11/2010 | Dube |
| 7,856,992 | B2 | 12/2010 | Zhou |
| 7,878,962 | B2 | 2/2011 | Karles |
| 7,984,719 | B2 | 7/2011 | Dube |
| 8,051,859 | B2 | 11/2011 | Yadav |
| 8,066,011 | B2 | 11/2011 | Clark |
| 8,118,035 | B2 | 2/2012 | Miser |
| 8,235,056 | B2 | 8/2012 | Zhuang |
| 8,356,607 | B2 | 1/2013 | Inoue |
| 8,459,272 | B2 | 6/2013 | Karles |
| 8,739,802 | B2 | 6/2014 | Fagg |
| 9,010,337 | B2 | 4/2015 | Kobal |
| 9,066,541 | B2 | 6/2015 | Allen |
| 9,107,452 | B2 | 8/2015 | Deevi |
| 9,119,421 | B2 | 9/2015 | Li |
| 9,149,072 | B2 | 10/2015 | Conner |
| 9,307,788 | B2 | 4/2016 | Dube |
| 9,332,786 | B2 | 5/2016 | Yokogawa |
| 9,554,594 | B2 | 1/2017 | Clark |
| 9,872,517 | B2 | 1/2018 | Reed |
| 9,907,335 | B2 | 3/2018 | Karles |
| 10,321,710 | B2 | 6/2019 | Kobal |
| 10,357,057 | B2 | 7/2019 | Kadiric |
| 10,568,356 | B2 | 2/2020 | Karles |
| 10,609,955 | B2 | 4/2020 | Beard |
| 10,736,351 | B2 | 8/2020 | Kaihatsu |
| 10,765,143 | B2 | 9/2020 | Mishra |
| 10,893,700 | B2 | 1/2021 | Mishra |
| 11,019,842 | B2 | 6/2021 | Dube |
| 11,076,632 | B1 | 8/2021 | Ormaza |
| 11,311,044 | B2 | 4/2022 | Shoor |
| 2006/0078608 | A1 | 4/2006 | Gilinski |
| 2006/0135335 | A1 | 6/2006 | Dawson |
| 2006/0174901 | A1 | 8/2006 | Karles |
| 2007/0012327 | A1 | 1/2007 | Karles |
| 2007/0068543 | A1 | 3/2007 | Chen |
| 2007/0246054 | A1 | 10/2007 | Gedevanishvili |
| 2011/0023896 | A1 | 2/2011 | Dube |
| 2012/0024303 | A1 | 2/2012 | Sugai |
| 2012/0097179 | A1 | 4/2012 | Kesselman |
| 2012/0255569 | A1 | 10/2012 | Beard |
| 2013/0333710 | A1 | 12/2013 | Brown |
| 2014/0053855 | A1 | 2/2014 | Hartmann |
| 2014/0202479 | A1 | 7/2014 | Nicholls |
| 2014/0332014 | A1 | 11/2014 | Penrose |
| 2015/0027477 | A1 | 1/2015 | Yoshino |
| 2015/0164133 | A1 | 6/2015 | Davis |
| 2015/0296875 | A1 | 10/2015 | Camus |
| 2017/0000185 | A1 | 1/2017 | Risso |
| 2018/0160724 | A1 | 6/2018 | Guyard |
| 2020/0100539 | A1 | 4/2020 | Mendoza |
| 2020/0146340 | A1 | 5/2020 | Alderman |
| 2020/0268043 | A1 | 8/2020 | Partouche |

FOREIGN PATENT DOCUMENTS

| | | |
|---|---|---|
| KR | 20070100422 | 10/2007 |
| UA | 105677 C2 | 6/2014 |
| WO | 03009711 | 2/2003 |
| WO | 2015014610 | 2/2015 |
| WO | 2015091792 | 6/2015 |
| WO | 2020142002 | 7/2020 |
| WO | 2022129613 | 6/2022 |

OTHER PUBLICATIONS

King Palm Slim Size Cones, Amazon.com, 2017, [online], retrieved from the Internet, [retrieved Nov. 28, 2023], <URL:h ttps://www.amazon.com/Slim-Size-Palm-Leafs-Pack/dp/B077GBKCDX/ref=sr_1_6?crid=3C7HBR2ONZMWI&keywords=king%2Bpalm%2Bcones&qid=1701208254&s=hpc&sprefix=King%2BPalm%2Chpc%2C92&sr=1-6&th=1 (Year: 2017).*
Amazon King Palm, Jul. 24, 2018 (Year: 2018), 2 pages.
English machine translation of abstract of CN 103726410 A; Pub. Date: Apr. 16, 2014; Liu; 2 pages—Abstract and Claims. (Year: 2014).
English machine translation of abstract of WO 9725886 A1; Roca; Jul. 24, 1997; 4 pages. (Year: 1997).
English machine translation of CN 105813483 A; Jul. 27, 2016; Reed; 19 pages. (Year: 2016).
English machine translation of JP 2017503477 A1; Feb. 2, 2017; 13 pages. (Year: 2017).
English machine translation of KR20070100422; Oct. 10, 2007; 14 pages; Karles. (Year: 2007).
English machine translation of TW202041156A; Nov. 16, 2020; Kiew; 46 pages. (Year: 2020).
English machine translation of UA 105677 C2; Pub Date: Jun. 10, 2014; 38 pages; Bessho, 38 pages, p. 4 (last three lines)—p. 5, lines 1-7. (Year: 2014).
English machine translation of WO 2011086751 A1; Kato; Jul. 21, 2011; 31 pages. (Year: 2011).
King Palm "About US" web page at <URL: https://kingpalm.com/about>, Feb. 2019, retrieved from the Internet at <URL: https://web.archive.org/web/20190205084640/https://kingpalm.com/about#>, on Nov. 8, 2022, 4 pages.
King Palm "High Quality Natural Palm Leaf Blunts" web page at <URL: https://kingpalm.com/>, Jun. 12, 2018, retrieved from the Internet at <URL: https://web.archive.org/web/20180612075453/https://kingpalm.com/>, on Nov. 8, 2022, 4 pages.
King Palm; Feb. 1, 2021; 1 page. (Year: 2021).
Natural Blunt Wraps; 2020; 28 pages. (Year: 2020).
Wayback Machine for cordia Natural Blunt Wraps; 2020; 1 page. (Year: 2020).
Wayback Machine for cordia Wikipedia; 2004; 1 page. (Year: 2004).
Wayback Machine for King Palm; Feb. 1, 2021; 1 page. (Year: 2021).
Wikipedia for cordia; 2004; 8 pages. (Year: 2004).

* cited by examiner

HOLLOW LEAF TUBE WITH FLAVOR CAPSULE

CROSS-REFERENCE TO RELATED APPLICATIONS

This application is a divisional of U.S. patent application Ser. No. 18/174,998, filed Feb. 27, 2023, entitled "Hollow Leaf Tube with Flavor Capsule, which is a continuation of U.S. patent application Ser. No. 17/727,214, filed Apr. 22, 2022, entitled "Hollow Leaf Tube with Flavor Capsule", which is a continuation of U.S. patent application Ser. No. 16/746,638, filed Jan. 17, 2020, entitled "Hollow Leaf Tube with Flavor Capsule" (which issued as U.S. Pat. No. 11,311,044 on Apr. 26, 2022), which are hereby incorporated herein by reference in their entirety.

BACKGROUND

Technical Field

This disclosure relates to flavored smoking materials. More specifically, this disclosure relates to a hollow leaf tube having a flavor capsule contained within a filter element.

Related Art

Hand-rolled cigarettes, cigars, or cigarillos generally do not have an incorporated filter. Filters can be purchased and included in such a hand-rolled smoke, but these are commonly formed from synthetic materials such as cellulose acetate (a plastic) and rayon. The cellulose acetate tow fibers are thinner than sewing thread, white, and packed tightly together to form a filter element and included in the hand-rolled smoke. Burning or inhaling such synthetic fibers can create hazardous situation for the smoker. In addition, flavors are not easily added to hand-rolled cigarettes, cigars, or cigarillos.

SUMMARY

One aspect of the disclosure provides a smoking accessory. The smoking accessory can include a tubular member formed from a dried leaf having an internal elongated cavity extending from an open end to a closed end, the elongated cavity being configured to receive a smoking material. The smoking accessory can include a filter disposed within dried leaf and defining the closed end. The filter can have a cylindrical body extending from a first end to a second end. The filter can have a recess formed in a surface of the cylindrical body along a curved face extending from the first end to the second end, the recess extending radially into the cylindrical body. The smoking accessory can include a capsule containing a flavoring agent disposed within the recess.

The filter can be formed from corn husk. The filter can have a filter wrapper and a filter element. The filter can be independently wrapped and contained by a friction within the elongated cavity of the tubular member. The filter wrapper can include at least one piece of natural fiber string. The dried leaf can include cordia leaf. Crushing the capsule disperses the flavoring agent within the filter to impart a flavor into the smoke. The recess can completely penetrate the filter.

Another aspect of the disclosure provides a hollow leaf tube. The hollow leaf tube can have a tubular member having an internal elongated cavity extending from a first end to a second end. The elongated cavity can receive a smoking material. The hollow leaf tube can have a filter having a cylindrical body and a recess formed in a surface of the cylindrical body, the recess extending radially through the cylindrical body. The hollow leaf tube can have a capsule containing a flavoring agent disposed within the recess.

Other features and advantages will be apparent to one of ordinary skill with a review of the following description.

BRIEF DESCRIPTION OF THE DRAWINGS

The details of embodiments of the present disclosure, both as to their structure and operation, can be gleaned in part by study of the accompanying drawings, in which like reference numerals refer to like parts, and in which.

DETAILED DESCRIPTION

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
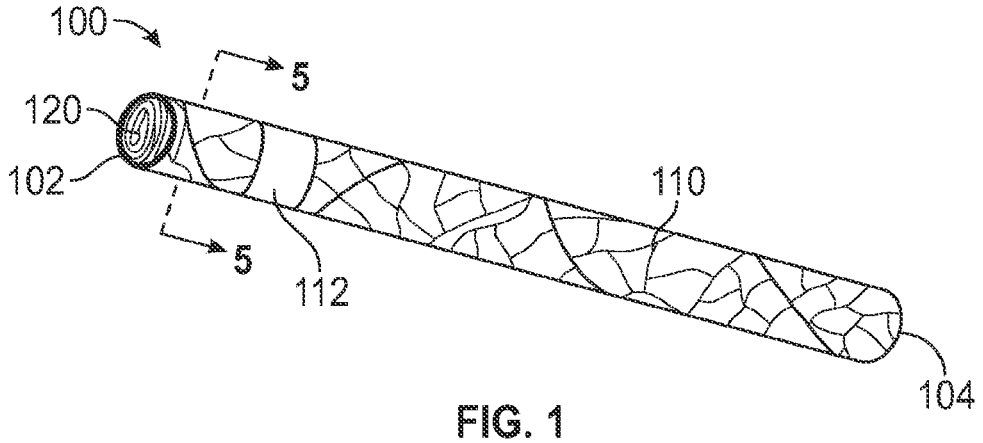
FIG. 1 is a perspective view of an embodiment of a hollow leaf tube. A hollow leaf tube 100 can be a tubular member formed from a dried leaf 110.

FIG. 1 is a perspective view of an embodiment of a hollow leaf tube. A hollow leaf tube 100 can be a tubular member formed from a dried leaf 110. The dried leaf 110 can extend from a first end 102 to a second end 104. The first end 102 can have a filter 120, forming a closed end of the hollow leaf tube 100. The hollow leaf tube 100 can have a central axis 101 following an imaginary line through the center of the hollow leaf tub from the first end 102 to the second end 104. The description refers to axial and radial directions. Axial refers to directions along the central axis 101, while radial refers to a direction orthogonal to the central axis 101.

Figure 2:
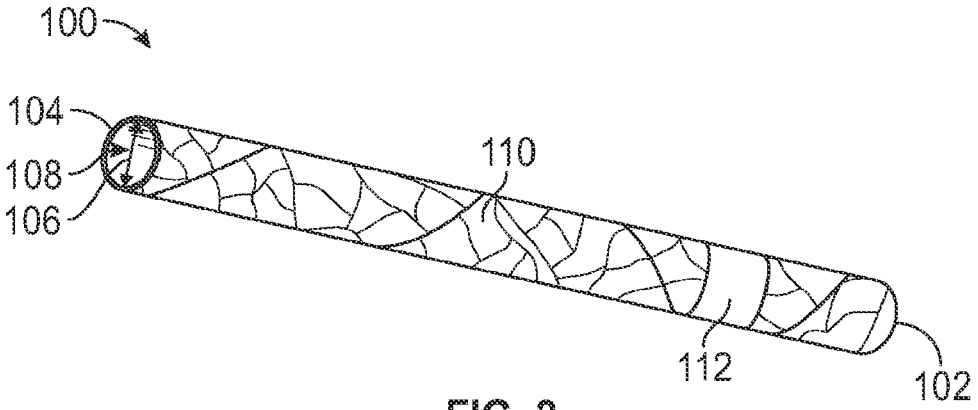
FIG. 2 is another perspective view of the hollow leaf tube of FIG. 1.

FIG. 2 is another perspective view of the hollow leaf tube of FIG. 1. FIG. 1 and FIG. 2 are referenced in the following description.

The second end 104 can open into an elongated internal cavity 108 having an inner diameter 106. The internal cavity 106 can receive a smoking material 140 (see FIG. 6). In some implementations, the dried leaf 110 can be any natural plant leaf that can be rolled into a tube. In some examples, the dried leaf 110 can be a tree or plant leaf such as, cordia, manjack, bocote, palm, or other leaves. Cordia is a primary example used herein, but is not limiting on the disclosure. Cordia can include flowering plants (e.g., shrubs and trees) in the borage family, Boraginaceae. In general, the dried leaf 110 can be a thick, pure and all natural leaf (i.e., no additives), without glue or other adhesives, and green leaf. The dried lead 110 can also be tobacco free. The dried leaf 110 can provide a resilient and aesthetically appealing green that burns slowly.

The leaf can be rolled around a form and dried in place to form the dried leaf 110 of the hollow leaf tube 100. In some other examples, the leaf can be (partially) dried and then rolled into the desired shape. The dried leaf 110 can be secured in a tubular form with a ring 112. The ring 112 can be a section of paper or other appropriate fastener wrapped around and adhered to itself holding the dried leaf 110 in its hollow form/tubular shape and prevent the dried leaf 110 from unwrapping. The ring 112 can further be adhered to the dried leaf 110 to maintain the tubular shape.

Figure 3:
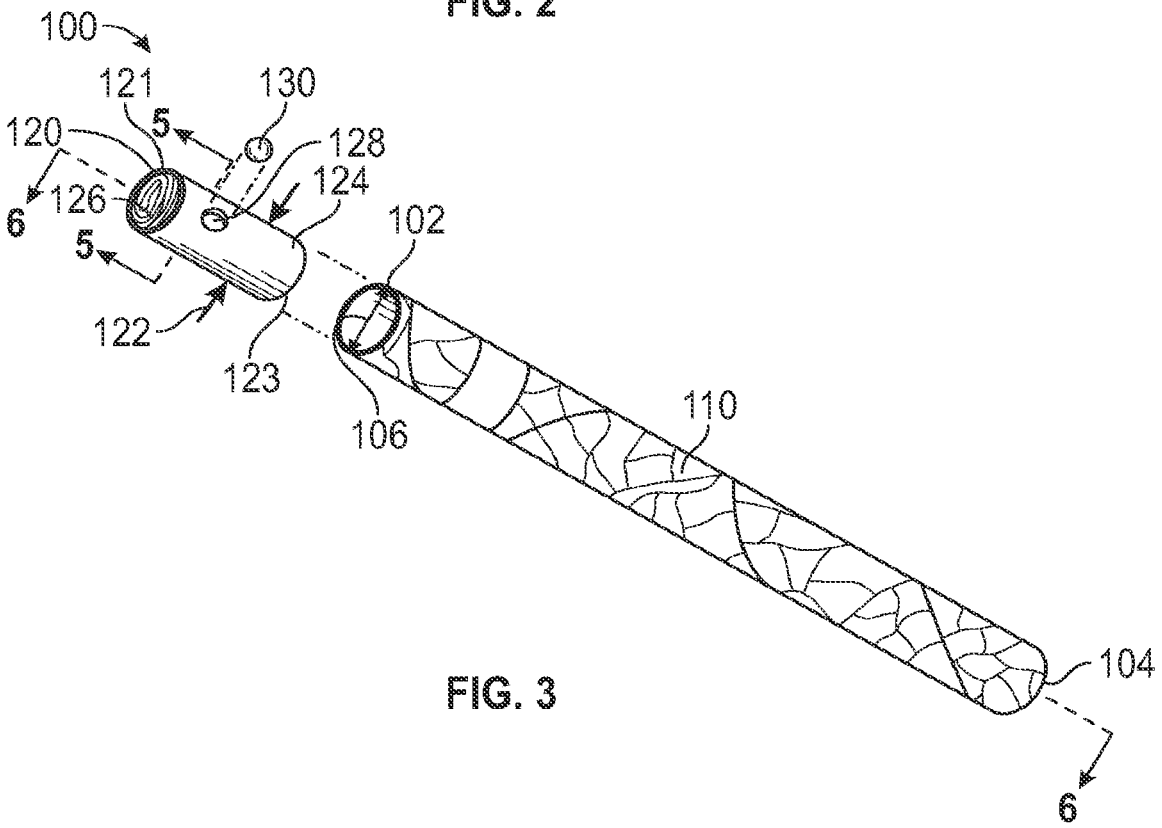
FIG. 3 is an exploded view of the hollow leaf tube of FIG. 1 and FIG. 2.

FIG. 3 is an exploded view of the hollow leaf tube of FIG. 1 and FIG. 2. The filter 120 can have a cylindrical body/shape having an outer diameter 122 extending from a first end 121 to a second end 123. The outer diameter 122 can be approximately equal to the inner diameter 106 of the first end 102 of the hollow leaf tube 100. The filter 120 can be received within the first end 102 in an interference or friction fit. In some examples, the filter 120 can be rolled into the dried leaf 110 when forming the hollow leaf tube 100. In some implementations, the filter 120 can be removed and/or replaced from the hollow leaf tube 100 as needed.

The filter 120 can have a filter wrapper 124 (e.g., a plug wrap) enclosing a filter element 126. The filter element 126 can be formed from natural fibers. In some examples, the filter element 126 can be formed by rolling corn husks. The corn husks can be shredded and rolled (e.g., hand-rolled or machine-rolled) into a cylindrical shape, forming the filter element 126. In some implementations, the filter element 126 can be held in the cylindrical shape by the filter wrapper 124. The filter wrapper 124 can be a section of ordinary paper (e.g., kraft paper) wrapped around the filter element 126. In other implementations, the filter 120 can be completely formed of corn husk without any paper. In some other implementations, the filter wrapper 124 can be one or more sections (e.g., lengths) of string formed from natural fibers. The string can be wrapped and tied around, for example, the ends of the filter element 126 to maintain a round shape.

The filter 120 can have a recess 128. The recess 128 can be formed in a surface of the filter 120 along a curved face extending from the first end and the second end.

Figure 4:
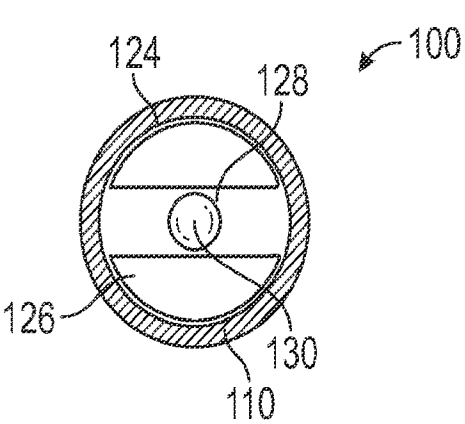
FIG. 4 is a cross-section of an embodiment of the hollow leaf tube taken along the line 5-5 of FIG. 1.

FIG. 4 is a cross-section of an embodiment of the hollow leaf tube taken along the line 5-5 of FIG. 1. The recess 128 can be a cavity or orifice bored, punched, or otherwise formed in the surface of the filter 120. The recess 128 can extend into the cylindrical body of the filter 120. In some implementations, the recess 128 can penetrate the wrapper 124 and extend radially through the filter element 126. The recess 128 can penetrate both the filter wrapper 124 and the filter element 126 extending completely through the filter 120.

In other implementations, the recess 128 may not penetrate the wrapper 124 and thus be an indentation in the surface of the wrapper 126 and the filter 120. In general, the capsule 130 can be set within the recess 128 and thus contained within the recess 128 by the dried leaf 110 when the filter 120 is inserted within the hollow leaf tube 100.

The recess 128 can be sized to receive a capsule 130. The capsule 130 can be a flavor capsule containing a flavoring agent. The capsule 130 can be a gelatin capsule. In other implementations, the capsule 130 can be formed from vegetable-based materials (e.g., a vegetable capsule). The flavoring agent can be a fluid operable to penetrate the filter element 126 and impart a flavor on the smoke drawn through the filter 120. The flavoring agent can be released when the capsule 130 is crushed. The flavoring agent within the capsule 130 can be, for example, a food grade essential oil or food grade candy oil. In some implementations, the flavoring agent can also include natural terpene liquid in various flavors (e.g., fruit or dessert flavors).

Figure 5:
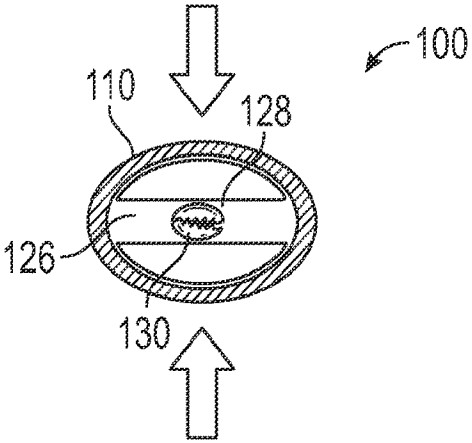
FIG. 5 is another view of the cross section of FIG. 4.

FIG. 5 is another view of the cross section of FIG. 4. When an external force (e.g., a pinching motion) is exerted on the closed end 102 of the hollow leaf tube 100 (e.g., on the filter 120 and the capsule 130), the capsule 130 can be burst, releasing the flavoring agent into the filter element 126. The flavoring agent can be drawn into smoke that passes through the filter 120.

Figure 6:
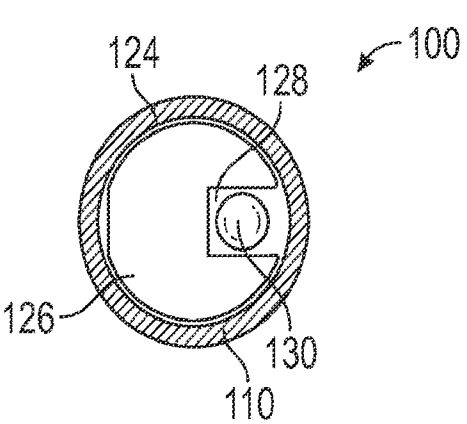
FIG. 6 is a cross-section of another embodiment of the hollow leaf tube taken along the line 5-5 of FIG. 1.

FIG. 6 is a cross-section of another embodiment of the hollow leaf tube taken along the line 5-5 of FIG. 1. In some implementations, the recess 128 can penetrate the wrapper 124 and extend radially into a portion of the filter element 126 but not all the way through the filter 120. Thus the recess 130 can thus form a pocket within the filter 120.

Figure 7:
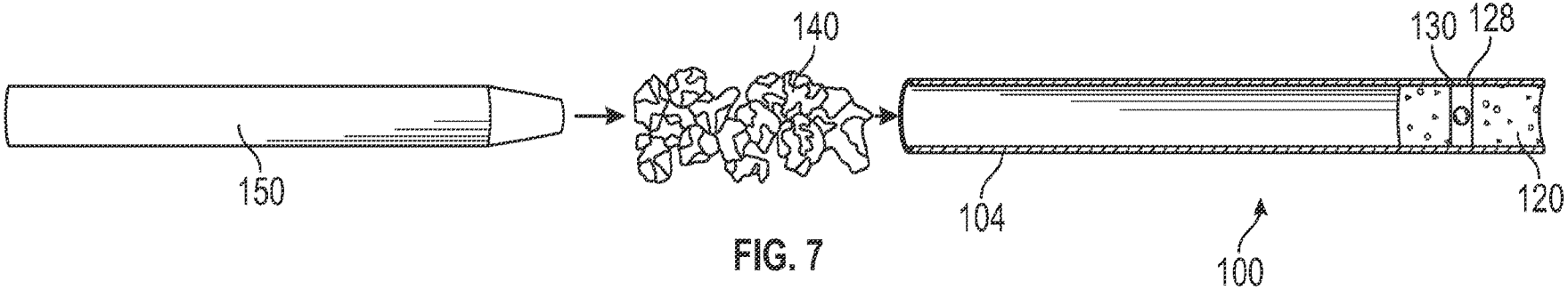
FIG. 7 is graphical depiction of the hollow leaf tube of FIG. 1 in use.

FIG. 7 is graphical depiction of the hollow leaf tube of FIG. 1 in use. In some embodiments a smoking material 140 can be inserted into the open end 104 of the hollow leaf tube 100. A packing stick 150 can be used to compress the smoking material within the hollow leaf tube 100 against the filter 120.

Other Aspects

The previous description is provided to enable any person skilled in the art to practice the various aspects described herein. Various modifications to these aspects will be readily apparent to those skilled in the art, and the generic principles defined herein may be applied to other aspects.

Thus, the claims are not intended to be limited to the aspects shown herein, but is to be accorded the full scope consistent with the language claims, wherein reference to an element in the singular is not intended to mean "one and only one" unless specifically so stated, but rather "one or more."

The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more.

Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C.

Although the present disclosure provides certain example embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A method, the method comprising:

forming a filter element from natural fibers, the filter element having an element body surrounding a central axis, the element body extending from a first end to a second end along the central axis;

forming an orifice in at least one surface of the filter element, the orifice extending into the element body in a radial direction relative to the central axis;

inserting a capsule into the orifice, the capsule comprising a flavoring agent; and after inserting the capsule into the orifice, positioning the filter element within an internal elongated cavity of a member body comprising one or more dried leaves, wherein the capsule is contained within the orifice by one or more dried leaves of the member body.

2. The method of claim 1, wherein the filter element comprises corn husk.

3. The method of claim 1, wherein forming the filter element comprises rolling the natural fibers around the central axis.

4. The method of claim 1, further comprising:

forming the member body from the one or more dried leaves, the member body having the internal elongated cavity extending from a first member end to a second member end; and wherein positioning the filter element within the internal elongated cavity of the member body comprises positioning the filter element adjacent to the second member end.

5. The method of claim 4, wherein forming the member body comprises rolling the one or more dried leaves into a shape.

6. The method of claim 4, wherein the one or more dried leaves comprises Cordia leaf.

7. The method of claim 1, further comprising:

wrapping the member body around the filter element after inserting the capsule into the orifice.

8. The method of claim 1, wherein forming the orifice in the at least one surface of the filter element comprises one of boring and punching the orifice into the at least one surface of the filter element.

9. The method of claim 1, further comprising:

wrapping a filter wrapper around the filter element; and forming the orifice by cutting through the filter wrapper and into the filter element forming an air gap between the capsule and the one or more dried leaves when the capsule is disposed within the orifice.

10. The method of claim 1, further comprising:

wrapping a filter wrapper around the filter element, wherein forming the orifice in at least one surface of the filter element comprising forming an indention into the filter wrapper and the filter element, wherein the capsule is contained in the indention between the filter wrapper and one or more dried leaves.

11. A method, the method comprising:

rolling one or more dried Cordia leaves to form a member body, the member body having an internal elongated cavity extending along a first central axis;

forming a filter element from natural fibers;

disposing a capsule into the filter element, the capsule comprising a flavoring agent; and positioning the filter element, containing the capsule, within the internal elongated cavity of the member body, wherein the capsule is contained within the filter element by the one or more dried Cordia leaves of the member body.

12. The method of claim 11, wherein the filter element comprises corn husk.

13. The method of claim 11, wherein forming the filter element comprises rolling the natural fibers around a second central axis.

14. The method of claim 11, further comprising:

rolling the one or more dried Cordia leaves around the filter element after the capsule is inserted into the filter element.

15. The method of claim 11, further comprising:

forming an orifice in at least one surface of the filter element; and inserting the capsule into the orifice, wherein the capsule is contained within the orifice by the one or more dried Cordia leaves of the member body.

16. The method of claim 15, wherein forming the orifice in the at least one surface of the filter element comprises one of boring and punching the orifice into the at least one surface of the filter element.

* * * * *